US005324546A

United States Patent [19]

Crutchley

[11] Patent Number: 5,324,546

[45] Date of Patent: Jun. 28, 1994

[54] PROCESS FOR PRODUCING COATINGS HAVING MULTIPLE RAISED BEADS SIMULATING LIQUID DROPLETS ON SURFACES OF ARTICLES

[75] Inventor: Edward B. Crutchley, Litchfield, Conn.

[73] Assignee: Henlopen Manufacturing Co., Inc., New York, N.Y.

[21] Appl. No.: 957,734

[22] Filed: Oct. 7, 1992

[51] Int. Cl.[5] ..... B05D 1/04

[52] U.S. Cl. ..... 427/469; 427/256; 427/262; 427/287; 427/470; 427/484; 427/486

[58] Field of Search ..... 427/466, 469, 470, 484, 427/485, 486, 256, 262, 287, 261

[56] References Cited

U.S. PATENT DOCUMENTS

| | | | |
|---|---|---|---|
| 1,907,094 | 5/1933 | Smith | 427/262 |
| 2,268,012 | 12/1941 | Bede . | |
| 2,511,627 | 6/1950 | Einbecker . | |
| 2,576,290 | 11/1951 | Fisher, Jr. . | |
| 3,811,915 | 5/1974 | Burrell et al. | 427/262 |
| 4,008,115 | 2/1977 | Fairbanks et al. . | |
| 4,233,343 | 11/1980 | Barker et al. | 427/262 |
| 4,673,596 | 6/1987 | Shoji et al. . | |
| 4,849,768 | 7/1989 | Graham . | |
| 4,948,633 | 8/1990 | Wu . | |

*Primary Examiner*—Terry J. Owens
*Attorney, Agent, or Firm*—Cooper & Dunham

[57] ABSTRACT

A process for producing an adherent relief coating simulating the appearance of liquid droplets on a surface of an article such as a cosmetics container, including the steps of applying the coating by spraying the surface with a curable liquid coating material to form a multiplicity of discrete raised beads of the material distributed over the surface, and curing the applied coating. The beads can be formed by spraying the beading coat under conditions controlled to provide insufficient atomization to form a continuous uniform coating; by applying two successive coatings with silicon or silicone additive incorporated in the first coat to promote autoreticulation of the second coat; or by a combination of these techniques.

9 Claims, 2 Drawing Sheets

FIG. 1
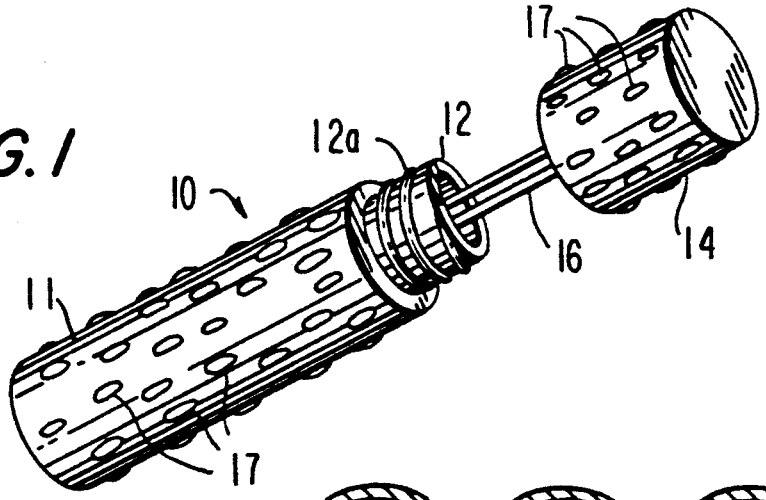
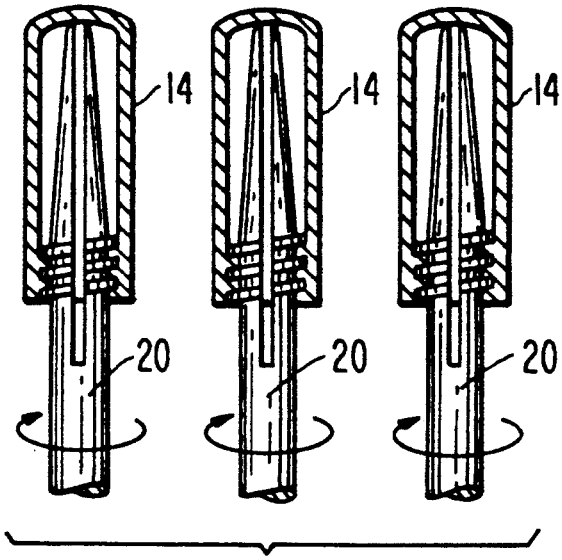
FIG. 4
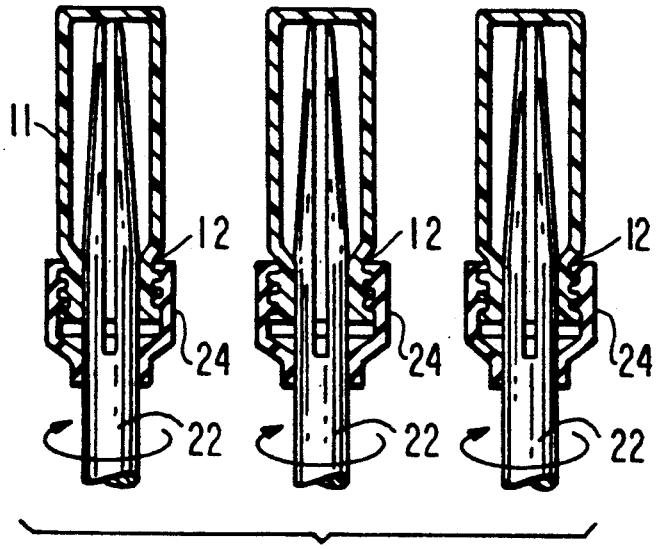
FIG. 5

PROCESS FOR PRODUCING COATINGS HAVING MULTIPLE RAISED BEADS SIMULATING LIQUID DROPLETS ON SURFACES OF ARTICLES

BACKGROUND OF THE INVENTION

This invention relates to processes for coating articles, and more particularly to processes for producing, on external surfaces of articles, relief coatings of novel and attractive character. The term "relief coatings," as herein used, refers to coatings characterized by local three-dimensional surface irregularities or variations in contour, such as bumps or beads, that are formed in and of the coating material itself and are readily visible and/or tactile.

It is often desired, for reasons of consumer appeal and product identification, to provide cosmetics containers or packages with an external appearance or decor which is novel or unusual as well as attractive and distinctive. In one important aspect, the invention is specifically concerned with the production of relief coatings for such containers or packages.

Illustrative examples of cosmetics packages suitable for coating by the process of the invention are the generally cylindrical, rigid containers of plastic or metal used for lipstick, mascara and the like. These containers commonly have smooth surfaces, which may be bare or covered with a smooth transparent or colored coating. The diversity of aesthetic effects capable of being thus created, however, is limited; and, in addition, flaws or defects in a smooth surface are readily visible. It is known to enhance the surface appearance of cosmetics containers with three-dimensional design elements by molding, embossing or attaching relief features, but these expedients involve some complexity of fabrication or assembly and, again, the range of effects that can thereby be produced is restricted.

More generally, it is known to provide articles with coatings of variegated color as well as coatings exhibiting some degree of relief or roughness, such as wrinkle coatings. Insofar as these known coating techniques are applicable to cosmetics packages, they also are limited as to the types of decorative effects they can impart.

For cosmetics containers that are commonly carried in a user's handbag, and are repeatedly opened for withdrawal of portions of the contents, it is important that any coating or other surface appearance feature be resistant both to abrasion (by objects in handbags) and to chemicals (of the contained cosmetics) that may come into contact with it incident to normal use. These requirements impose constraints on the creation of decorative effects.

SUMMARY OF THE INVENTION

The present invention broadly contemplates the provision of processes for producing, on extended surfaces of articles, an adherent relief coating simulating the appearance of liquid droplets, so as to impart a "wet look" to the articles. In this broad sense, the process of the invention comprises the steps of applying a coating to an extended surface of an article, the applying step including spraying the surface with a curable liquid coating material for forming thereon a multiplicity of discrete raised beads of the material distributed over the surface; and, while the multiplicity of discrete raised beads is present on the surface, curing the applied coating.

As a particular feature of the invention, in certain embodiments thereof, the applying step further includes applying a smooth, continuous coating layer on the surface before performing the spraying step, such that the spraying step deposits the curable liquid coating material onto this layer. Advantageously or preferably in many instances, the continuous coating layer contains a substance that promotes formation of discrete raised beads by autoreticulation of the curable liquid coating material when the curable liquid coating material is sprayed onto it. For example, the substance used for the continuous coating layer may be a silicon or silicone-type additive.

The beads may be produced, in such case, by the bead-forming (autoreticulation) effect of the continuous coating layer on the subsequently sprayed curable coating material. Additionally, or alternatively (if the continuous coating layer is omitted or does not promote autoreticulation), formation of beads of the curable coating material can be achieved by performing the spraying step under atomization conditions controlled to provide a degree of atomization of the curable liquid coating material insufficient to form a continuous uniform coating of the curable liquid coating material on the surface.

More particularly, when the article is an electrically conductive (e.g. metal) article, the spraying step can be performed by electrostatic spraying using a rotating spray disc charged to a predetermined voltage, at least one of the speed of rotation of the disc and the voltage being controlled to provide a degree of atomization of the liquid coating material insufficient to form a continuous uniform coating of the curable liquid coating material on the surface. In other embodiments of the invention (suitable for coating electrically nonconductive articles such as plastic articles, as well as for coating metal articles), the spraying step is performed with a spray gun that atomizes the liquid coating material under pressure, the atomization pressure being controlled to provide a degree of atomization of the liquid coating material that is, again, insufficient to form a continuous uniform coating of the curable liquid coating material on the surface.

Preferably in many instances, the step of spraying the curable liquid coating material on the article surface is performed in at least two successive spray applications.

The invention, as stated, has important applicability to the coating of cosmetics containers (although in its broader aspects it is not limited thereto), for simulating the appearance of water droplets on the container surface. In preferred specific embodiments of the invention for coating cosmetics containers, wherein the surface to be coated is at least the lateral exterior surface extending around the container, the spraying step is performed by discharging an atomized spray of the curable liquid coating material from a source while moving the article through the path of the atomized spray so as to expose the surface to the atomized spray entirely around the container, and advancing the article out of the path of the spray while the multiplicity of discrete raised beads is present on the surface.

The wet look (three-dimensional water droplet appearance) achieved by the process of the invention has not heretofore been attainable, using conventional techniques for coating or otherwise decorating cosmetics containers and the like. With appropriate selection of coating materials, the cured wet-look coating thus produced is satisfactorily resistant to abrasion (as in a user's handbag) and to attack by chemicals (e.g., ingredients of the contained cosmetics). It can be applied and cured simply and economically at high production rates. Moreover, the relief water-droplet coating effectively hides surface flaws or defects, so that otherwise usable container bodies and caps need not be rejected because of such flaws.

Further features and advantages of the invention will be apparent from the detailed description hereinbelow set forth, together with the accompanying drawings.

BRIEF DESCRIPTION OF THE DRAWINGS

FIG. 1 is a perspective view of a mascara container, partially open, having a coating produced by the process of the present invention in an illustrative embodiment;

FIG. 4 is a fragmentary elevational view of a first set of spindles for transporting cosmetics container elements to be coated in the line of FIG. 2 or FIG. 3; and FIG. 5 is a fragmentary elevational view of a second set of spindles for transporting cosmetics container elements to be coated in the line of FIG. 2 or FIG. 3.

DETAILED DESCRIPTION

Figure 2:
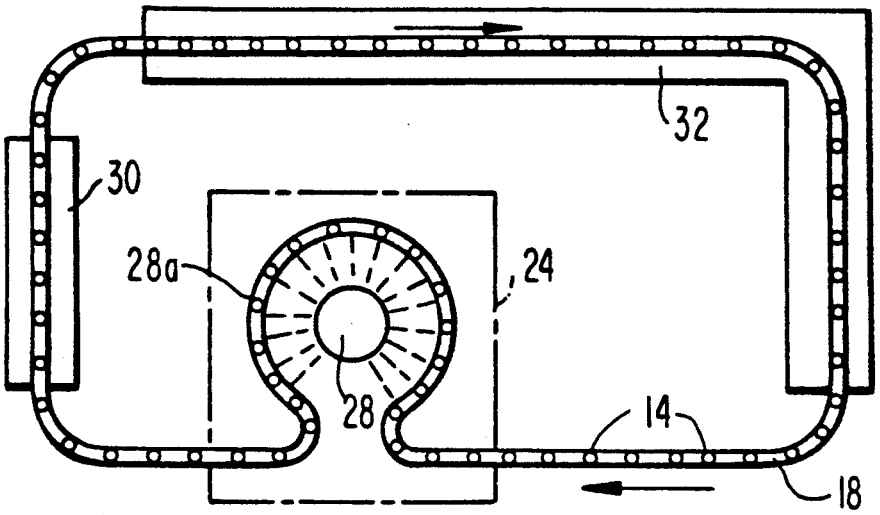
FIG. 2 is a schematic plan view of a coating line for practicing the process of the invention in an embodiment using electrostatic spraying.

The invention will be described, for purposes of illustration, as embodied in processes for coating the exterior of a generally conventional cosmetics container such as the mascara container 10 shown in FIG. 1. It will be appreciated, however, that the processes of the invention are broadly applicable to other types of articles as well.

Referring to FIG. 1, the container 10 includes an elongated body 11 for holding a quantity of mascara to be dispensed, with a closed lower end and a reduced-diameter open upper end portion 12 bearing an external thread 12*a*. The container also has a cylindrical cap 14, with an external diameter equal to that of the lower or main portion of the body 11, carrying an applicator 16 for insertion into the body 11 when the cap is in closed position. An internal thread (not shown) is formed within the cap to engage the thread 12*a* of the body portion 12 to hold the cap in closed position on the body.

The body and cap are rigid, self-sustaining elements, fabricated of any of a wide variety of metals and plastics; typical or exemplary materials include polypropylene, polythene, aluminum and brass. Suitable known techniques for forming them include injection molding and injection blow molding (for plastics) and drawing (for metals). They may be cylindrical in shape, as shown, or may have other configurations, such as oval, square or rectangular cross-sections. The cap and body may be made of different materials; for instance, the cap may be metal, and the body may be a plastic.

The external surfaces of both the body 11 and the cap 14 have a surface coating, including a multiplicity of discrete raised beads 17 of the material forming the coating, produced by the process of the present invention as hereinafter described. These beads impart to the container 10 a wet look, i.e., an appearance of being covered with droplets of water. The droplet effect is three-dimensional in nature, the beads being both visible and tactile; hence the coating is a relief coating. The beads are solid, rigid and sufficiently resistant to abrasion and to the chemicals of the contained mascara so that the appearance of the container does not deteriorate in normal use. They also serve to conceal surface defects.

Treatment of the cap and body elements in preparation for coating by the process of the invention depends on the material of which those elements are constituted. Metal surfaces require no special pretreatment other than ordinary polishing and cleaning to ensure that they will be adequately receptive to applied coatings. All exterior coatable surfaces of plastic caps and bodies, however, are subjected to a preliminary modification treatment, such as a plasma, corona or flame treatment, to enhance adhesion of subsequently applied coatings; these treatments are well known to persons skilled in the art, and accordingly need not be further described.

Once any necessary pretreatment has been performed, the caps and bodies are subjected to the coating process of the invention, preferably on a high-speed production line. Examples of such a line, arranged for practice of the present process, are shown schematically in FIGS. 2 and 3. The line of FIG. 2 employs electrostatic spraying, and is thus adapted to coat electrically conductive (metal) elements, while the line of FIG. 3 employs spray guns and can be used to coat either metal or plastic elements. Each of these lines may be capable of coating one thousand to several thousand cap or body elements per hour and may be designed to complete each coating cycle (spraying/flash-off/curing) in four minutes.

In each line, the bead-forming curable coating material applied by spraying to the cap or body elements is a varnish of a high solids, low viscosity type; that type of coating material is found to afford an optimum combination of dimensionality and sprayability. Coating of the cap or body elements may be effected in a single pass, but preferably, each element undergoes two separate and successive passes through the line. The first coat (which is optional) applies a continuous smooth film on the substrate; the second coat (and optional subsequent coats) ensure the beading of the varnish.

Figure 3:
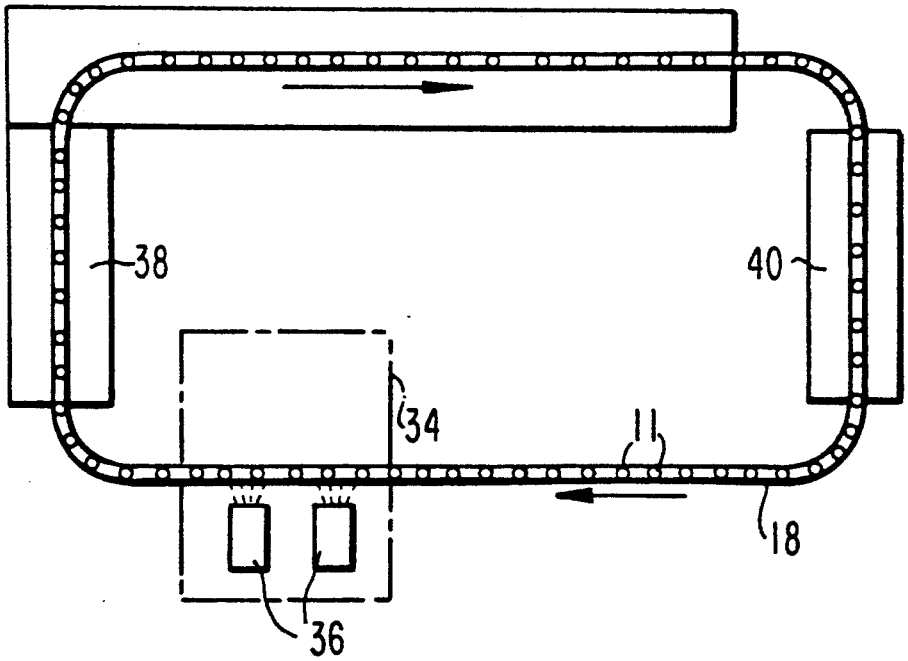
FIG. 3 is a similar schematic plan view of a coating line for practicing the process of the invention in an embodiment using spray guns.

Each of the production lines of FIG. 2 and FIG. 3 includes an endless conveyor 18 travelling in a horizontal path and having a multiplicity of upright spindles 20 (FIG. 4) or 22 (FIG. 5) spaced uniformly (e.g. one to two inches apart) along its length for holding caps or bodies to be coated. These spindles may be of generally conventional design, each having plural resilient fingers over which a cap or body element is fitted and by which the element is frictionally retained for transport along the coating line. Each of the spindles 22 of FIG. 5 additionally has a shield 24 for surrounding and protecting the externally threaded portion 12 of a container body to prevent coating material from reaching and clogging the threads. All the spindles are arranged, again in conventional manner, to rotate about their respective vertical axes during advance of the conveyor past the spraying locality, and thereby to present all lateral surfaces of each body or cap element to the spray; suitable mechanical expedients for effecting such rotation need not be described, as they will be readily apparent to persons skilled in the art. The placing of the caps or bodies on the spindles may be either manual or automatic.

In the case of containers having metal caps and plastic bodies, for example, the caps may be coated in the electrostatic spraying line of FIG. 2, which in that instance has spindles of the type shown at 20 in FIG. 4, since the caps (being internally threaded) do not require masking of any part of their external surfaces; and the bodies may be coated in the spray gun line of FIG. 3, which is then provided with spindles of the type shown at 22 in FIG. 5 including shields 24 for the external threads.

The conveyor 18 of the FIG. 2 line advances through an enclosed spray booth 24 within which is disposed a conventional electrostatic disc sprayer 28; as shown, the conveyor follows an omega-shaped (Ω) path 28a around the disc 28 to afford ample exposure of each cap or body element, on its rotating spindle, to the spray from the disc. The booth 24 is designed to protect workers and the environment from solvent fumes and overspray.

The electrostatic disc used is typically 6 to 10 inches in diameter and rotates up to at least 5,000 rpm. Rotations of the order of 500 rpm or less ensure partial atomization of the varnish and therefore promote beading. The disc is electrically isolated and charged typically up to 100,000 volts, although reduced atomization and consequently greater beading is achieved by reducing the voltage e.g. to 65,000 volts or less. Some charge is desirable so as to maintain reasonable transfer efficiency of the varnish to the substrate (cap or body).

Varnish is typically fed to the disc by a rotary pump. The omega-shaped path 28a is conveniently or preferably so positioned that the cap or body surfaces are maintained at a distance of about 12 inches from the edge of the disc while being sprayed. It is currently preferred that each spindle, and the cap or body element it carries, rotate at least twice while passing through the spray booth in exposure to the spray.

From the booth 24 of the FIG. 2 line, the wet-coated metal elements on their spindles are advanced by the conveyor to and through a flash-off zone 30 with a dwell time therein on the order of one minute, to drive off solvent of the coating material. The conveyor next carries the coated elements through a curing zone 32, in which they are exposed to infrared radiation from lamps (not shown) with a dwell time of about two minutes, for heating the elements to about 350° F., to cure the coatings. To achieve requisite full curing exposure of the applied coatings, the elements on their spindles are rotated in front of the infrared lamps, which are provided with reflectors for enhanced efficiency.

In the coating line of FIG. 3, used for cap and/or body elements that cannot be coated electrostatically, the conveyor with its spindles advances the elements through a spray booth 34 enclosing one or more automatic spray guns 36. As in the FIG. 2 line, the booth 34 is designed to protect workers and the environment from solvent fumes and overspray. It is preferred to utilize at least two of the guns 36, arranged in tandem, to ensure full coverage of the element surfaces. The path of advance of the conveyor past the spray guns is linear, with each element being rotated at least twice on its spindle while being exposed to the spray. Typically, varnish is supplied to the guns from a pressure pot at up to 20 psi, and atomization is effected at up to 60 psi. Improved beading is achieved at lower atomization pressures, e.g. 20 psi.

As in the FIG. 2 line, the coated elements in the FIG. 3 line advance through a flash zone 38 for a flash-off time of about one minute, and then pass through a curing zone 40. In the case of plastic elements, for which the FIG. 3 line is adapted, it is preferred that the curable coating material be an ultraviolet-curable varnish; curing in zone 40 may then be effected, for example, by exposing the coated element surfaces to up to 300 watts/inch of medium wave lamps for about 15 seconds. Again, the elements are rotated in front of the lamps so that their coatings are fully exposed to the curing radiation, and the lamps are provided with reflectors.

In either of the described coating lines, having a single spray booth, with a two-pass coating operation, the elements to be coated can be loaded onto the conveyor and the smooth base coat applied on the first pass, and the beading coat can be applied on the second pass without removing the elements from the line, thus minimizing handling. When this mode of operation is employed it is preferred to use constant application conditions for both passes (i.e., the same rotational speed and voltage for the electrostatic spraying in FIG. 2, or the same delivery and atomization pressures in the spray guns of FIG. 3) and to produce beading entirely by autoreticulation of the second coating as described below.

That is to say, in the process of the invention, beading can be effected by either of, or a combination of, the following techniques: (a) reduced atomization conditions in the application of the beading coat and (b) use of two coatings, base coat and top coat, with a silicon or silicone-type additive incorporated in the base coat to promote autoreticulation of the top coat. Technique (b) produces a more regular bead shape and pattern than technique (a).

For both infrared curing and ultraviolet curing, the volatile solvent content of the coating materials is preferably limited to a maximum of 4.3 lbs./gallon of varnish, and viscosity is preferably limited to about 15–25 seconds measured on Zahn cup #2, although higher viscosity can facilitate beading produced by lowering atomization.

When two (or more) coating layers are applied, intercoat adhesion is ensured by judicious use of heating conditions and additives. Too much of either will not allow the beads to adhere to the base coat; too little curing or additive will discourage autoreticulation.

Bead size and density can be influenced by the number of topcoat passes, the varnish delivery rate, and/or reduced atomization conditions. Increasing the number of topcoat passes increases the number of beads (bead density), although this result to some extent diminishes the wet look effect. Increase of varnish delivery rate to the disc of FIG. 2 or the guns of FIG. 3 lessens the bead density but increases the size of individual beads produced by autoreticulation. Reduced atomization conditions (lower rotation rate and/or voltage in FIG. 2; lower atomization pressure in FIG. 3) create fewer beads of larger size.

To increase the intricacy of the decorative effects produced by the process, transparent dyes can be added to the base coat (when used) and/or to the top coat.

The high solids low viscosity varnishes employed to coat the container elements can be commercially available products adapted to the equipment used. It is important that solvent balance be adjusted to allow good atomization and flowout without impairing the cured properties of the applied film. It is also important that the level of curing and hardness achieved be appropriate to the end use, high performance resins being selected for cosmetics containers to withstand handbag abrasion and exposure to contained chemicals. Of course, the coatings must also be able to meet applicable environmental regulations respecting air emissions.

Typical or exemplary coating materials are as follows:

(1) for heat curing on metal elements with electrostatic disc application: the varnish currently commercially available from Morton Coating, Inc., under the designation "BCM 561," which is a solvent-borne, low viscosity, thermosetting polyester coating; autoreticulation can be achieved by adding thereto, in an amount of about 2 oz./gallon, the product commercially available from Morton Coating, Inc., under the designation "CM 831," which is an organo-silicone.

(2) for ultraviolet curing on plastic elements with spray gun application: the varnish currently commercially available from Red Spot Inc., under the designation "UVT 106," which is a solvent-borne, low viscosity, polyfunctional acrylate coating; autoreticulation can be achieved by adding thereto, in an amount of about ½ oz./gallon, the product commercially available from Red Spot, Inc., under the designation "SV 4115," which is an organo-silicone.

The practice of various exemplary embodiments of the present process may now be readily explained. In a first embodiment, the container cap and body elements to be coated, after any necessary cleaning and/or other pretreatment, are sprayed (electrostatically or with a spray gun, depending on whether they are metal or plastic) with a single coat of a high-solids, low viscosity varnish under conditions of atomization insufficient to form a continuous surface coating of the varnish on the element surfaces. Discrete raised beads of the varnish are thus formed. With the beads present on the element surfaces, the coatings are subjected to flash-off and infrared or ultraviolet curing. Thereby a permanent stable coating of beads is achieved.

In a second embodiment, a first coating of the varnish is applied (electrostatically or by spray gun) to the element surfaces, under conditions of atomization sufficient to produce a generally uniform, continuous base coat. The varnish in this coating layer incorporates a silicon or silicone-type additive. The base coat is subjected to flash-off and infrared or ultraviolet curing. The base-coated elements are then coated again with the varnish, under the same atomization conditions used for applying the base coat, but with the additive preferably omitted from the varnish composition. The additive in the base coat promotes autoreticulation of the second coat, causing the second coat to form discrete raised beads. Like the base coat, the second (beaded) coat is subjected to flash-off and infrared or ultraviolet curing.

In a third embodiment, as in the second embodiment just described, a first coating of the varnish (containing a silicon or silicone-type additive) is applied to the element surfaces, under conditions of atomization sufficient to produce a generally uniform, continuous base coat, which is subjected to flash-off and infrared or ultraviolet curing. The base-coated elements are coated again with the varnish (this time omitting the additive), but under reduced atomization conditions so that beading is promoted both by autoreticulation (resulting from the first coat additive) and from the lowered atomization conditions. Like the base coat, the second (beaded) coat is subjected to flash-off and infrared or ultraviolet curing.

It is to be understood that the invention is not limited to the features and embodiments hereinabove specifically set forth but may be carried out in other ways without departure from its spirit.

I claim:

1. A process for producing, on an extended surface of an article, an adherent relief coating simulating the appearance of liquid droplets, said process comprising applying a coating to the surface, said applying step including spraying the surface with a curable liquid coating material thereby forming thereon a multiplicity of discrete raised beads of said material distributed over said surface; and, while the multiplicity of discrete raised beads is present on the surface, curing the applied coating.

2. A process according to claim 1, wherein the applying step further includes applying a smooth, continuous coating layer on the surface before performing the spraying step, such that the spraying step deposits the curable liquid coating material onto said layer.

3. A process according to claim 2, wherein the continuous coating layer contains a substance that promotes formation of discrete raised beads of said curable liquid coating material when the curable liquid coating material is sprayed onto said layer.

4. A process according to claim 1, 2 or 3, wherein the spraying step is performed under atomization conditions controlled to provide a degree of atomization of the curable liquid coating material insufficient to form a continuous uniform coating of the curable liquid coating material on the surface.

5. A process according to claim 4, wherein the article is a metal article and the spraying step is performed by electrostatic spraying using a rotating spray disc charged to a voltage, at least one of the speed of rotation of the disc and the voltage being controlled to provide a degree of atomization of the liquid coating material insufficient to form a continuous uniform coating of the curable liquid coating material on the surface.

6. A process according to claim 4, wherein the spraying step is performed with a spray gun that atomizes the liquid coating material under pressure, the atomization pressure being controlled to provide a degree of atomization of the liquid coating material insufficient to form a continuous uniform coating of the curable liquid coating material on the surface.

7. A process according to claim 1, wherein said article is a cosmetics container, said surface is at least the lateral exterior surface extending around the container, and the spraying step is performed by discharging an atomized spray of the curable liquid coating material from a source while moving the article through the path of the atomized spray so as to expose said surface to the atomized spray entirely around the container, and advancing the article out of the path of the spray while said multiplicity of discrete raised beads is present on said surface.

8. A process according to claim 1, wherein the step of spraying said curable liquid coating material on said surface is performed in at least two successive spray applications.

9. A process according to claim 3, wherein said substance is a silicon or silicone additive.

* * * * *